US007321737B2

(12) United States Patent
Swann et al.

(10) Patent No.: US 7,321,737 B2
(45) Date of Patent: Jan. 22, 2008

(54) SYSTEM FOR AUTHENTICATING MODULES INSTALLED IN MACHINES, SUCH AS PRINTING APPARATUS

(75) Inventors: Kevin Swann, St. Albans (GB); Roger Huggins, Knebworth (GB)

(73) Assignee: Xerox Corporation, Norwalk, CT (US)

( * ) Notice: Subject to any disclaimer, the term of this patent is extended or adjusted under 35 U.S.C. 154(b) by 292 days.

(21) Appl. No.: 11/172,309

(22) Filed: Jun. 30, 2005

(65) Prior Publication Data

US 2007/0003293 A1 Jan. 4, 2007

(51) Int. Cl.
*G03G 15/00* (2006.01)

(52) U.S. Cl. ..... 399/12

(58) Field of Classification Search ..... 399/12, 399/13, 24

See application file for complete search history.

(56) References Cited

U.S. PATENT DOCUMENTS 4,961,088 A 10/1990 Gilliland et al.
6,986,057 B1 * 1/2006 Cusey et al. ..... 713/161

* cited by examiner

*Primary Examiner*—Hoang Ngo
(74) *Attorney, Agent, or Firm*—R. Hutter

(57) ABSTRACT

A method of operating a machine, such as a digital printing apparatus, involves installing into the machine a module having a first random number generator associated therewith, and, incidental to installing the module, initiating a second random number generator associated with the machine. The series of random numbers from each generator are checked against each other over time.

18 Claims, 1 Drawing Sheet

SYSTEM FOR AUTHENTICATING MODULES INSTALLED IN MACHINES, SUCH AS PRINTING APPARATUS

INCORPORATION BY REFERENCE

The following US Patent is hereby incorporated by reference in its entirety for the teachings therein: U.S. Pat. No. 4,961,088.

TECHNICAL FIELD

The present disclosure relates to a system for controlling replaceable modules, also known as "customer replaceable units" or CRUs, in a machine, such as a printer or copier.

BACKGROUND

A common trend in the maintenance of office equipment, particularly copiers and printers, is to organize the machine on a modular basis, wherein certain distinct subsystems of a machine are bundled together into modules which can be readily removed from machines and replaced with new modules of the same type. A modular design facilitates a great flexibility in the business relationship with the customer. By providing subsystems in discrete modules, visits from a service representative can be made very short, since all the representative has to do is remove and replace a defective module. Actual repair of the module takes place away at the service provider's premises. Further, some customers may wish to have the ability to buy modules "off the shelf," such as from an office supply store. Indeed, it is possible that a customer may lease the machine and wish to buy a succession of modules as needed. Further, the use of modules, particularly for supply units such as toner bottles, is conducive to recycling activities.

U.S. Pat. No. 4,961,088 discloses the basic concept of using an electronically-readable memory permanently associated with a replaceable module which can be installed in a digital printer. The embodiment disclosed in this patent enables a printer to check an identification number of the module, to make sure the module is authorized to be installed in the machine, and also enables a count of prints made with the module to be retained in the memory associated with the module.

SUMMARY

According to one aspect, there is provided a method of operating a machine, comprising installing into the machine a module having a first random number generator associated therewith; and, incidental to installing the module, initiating a second random number generator associated with the machine.

According to another aspect, there is provided a module installable in an apparatus, comprising a random number generator, and a memory for retaining an initial number to be applied to the random number generator.

According to another aspect, there is provided a method of operating an electrophotographic printing apparatus. There is installed into the apparatus a module having a first random number generator associated therewith, the module further including at least one of a container for retaining marking material and hardware suitable for electrophotographic printing. Incidental to installing the module, a second random number generator associated with the machine is initiated.

DETAILED DESCRIPTION

Figure 1:
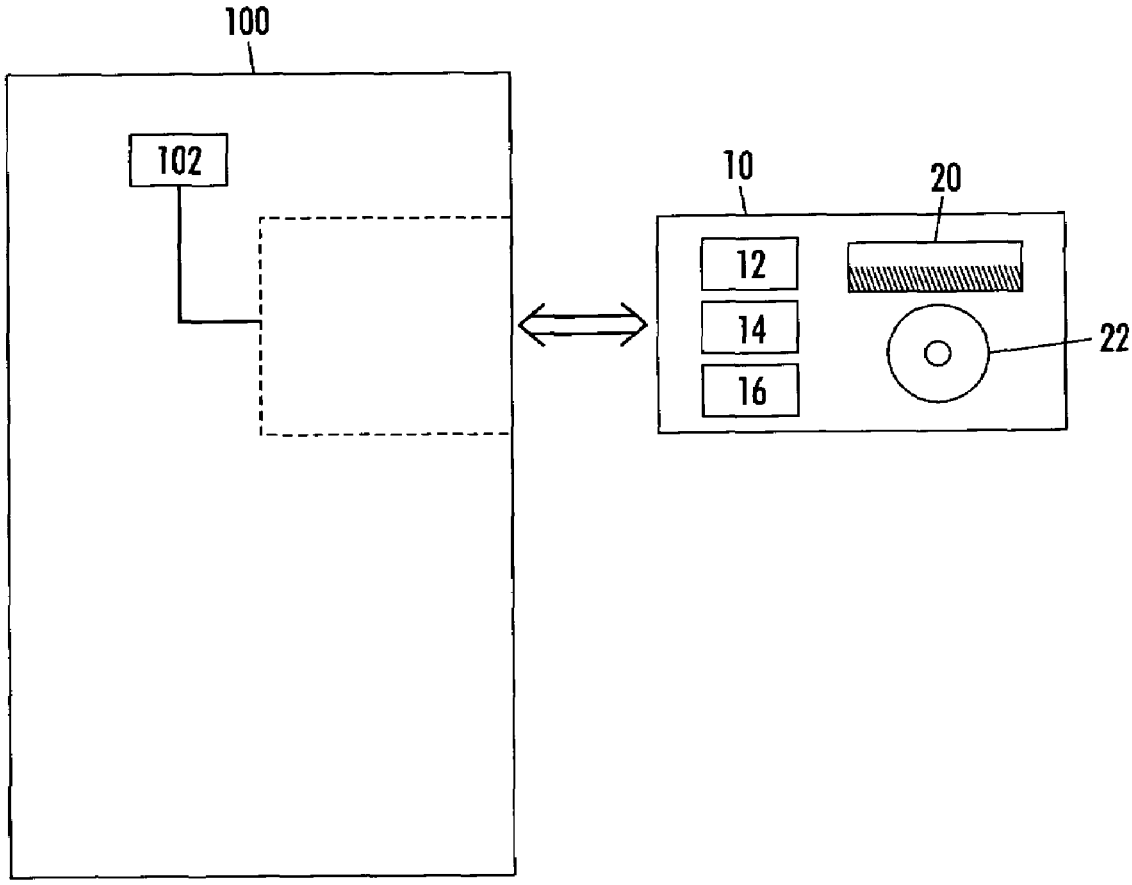
FIG. 1 is a simplified diagram showing a module installable in a machine.

Although the following discussion is directed to the placement of marking material modules in a digital printer, it will be understood that the teachings herein can be applied to any situation in which a module is installed within a larger machine, such as but not limited to, a computer, an automobile, a cleaning apparatus, a medical device, etc.

FIG. 1 is a simplified diagram showing a module 10 installable in a machine 100. In one embodiment, the module 10 contains marking material or other consumables (e.g., toner or liquid ink) in a container such as 20, and/or hardware (e.g., a photoreceptor 22 or ink-jet printhead) useful in a digital printer or copier such as 100. As described in detail, for example, in the patent incorporated by reference above, when the module 10 is initially installed in machine 100, a "handshake" operation ensues. Typically, a control system 102 of the machine 100 extracts from a memory 12 attached to the module 10 a code of some sort, said code being compared to a code retained in control system 102. If the codes match in some way, the module is accepted for use. The conveyance of data between module 10 and machine 100 can be undertaken through a direct electrical connection, or through wireless means.

According to the present embodiment, the code held in memory 12 on module 10 has two distinct parts: a pseudo-random number generator, or PRNG, 14, and an initial number which is loaded in the memory 12. As is well known in mathematics, a PRNG algorithm acts on an initial number, and outputs a new pseudo-random number with every application of the algorithm. (The random number generation is "pseudo" because, after a very large but finite number of iterations, the initial number will be output, causing the whole operation to loop. As used herein, the word "random" shall include pseudo-random.) Incidental to installation of the module 10, the initial number is in effect loaded into the PRNG 14, and the PRNG 14, using its algorithm, starts outputting a series of pseudo-random numbers over time. The successive pseudo-random numbers can be output at predetermined regular time intervals, or there can be some randomness involved in determining how far in the future the next pseudo-random number will be output, i.e., the PRNG can be used to calculate not only the next number to be output, but also calculate a pseudo-random number of seconds, for example, until the next number is output. In one possible embodiment, a useful range of regular time intervals between iterations is 0.1 to 1.0 seconds.

Further according to the present embodiment, also incidental to the installation of module 10 in machine 100, the control system 102 enters an initial number into its own PRNG. The PRNG in control system 102 is typically, but not necessarily, an algorithm running on a general-purpose processor. This initial number can be taken from a number pre-loaded in the memory 12 in module 10, or can originate in the machine 100. With the PRNG algorithm and initial number, the PRNG 14 outputs a predictable series of numbers, at regular or random intervals. The output of random numbers from PRNG 14 are emulated by the control system 102 of machine 100, which is equipped with the same PRNG algorithm and initial number.

Once the module 10 is installed in machine 100 and PRNG 14 outputs a series of random numbers, each (or some subset) of the random numbers in the series are checked against at least a sample of the random numbers being simultaneously output by the PRNG within control system 102 of machine 100. If the random numbers through time consistently match (or have some other predetermined relationship), then the module is deemed "acceptable" for use according to whatever criterion is required by a particular business model, e.g., acceptable to use, acceptable to use in a certain geographic area, acceptable to use with continuing warranty, etc. If the series of numbers output by the PRNG 14 does not match the numbers (or a sample of the numbers) output by the control system 102, then the module is deemed "not acceptable" for a particular business model, e.g., hard stop, hard stop in a certain geographic area, useable but with a display that any warranty is void, etc. Other strategies include allowing only a time-limited use of the module if a mismatch is detected, or communicating through a network to the vendor that a certain kind of module has been installed.

The repeated checking by control system 102 of the series of random numbers can occur at random or periodic intervals. Alternatively, the checking can be motivated by external events, such as a power-up or a request to start a print or copy job.

In one practical embodiment, a sequence of operations is as follows. A user inserts a new (or effectively new, such as remanufactured) module 10 into machine 100, effectively connecting the PRNG 14 with the control system 102, by direct electrical connection or other means. At this first insertion, control system 102 reads the initial number from the memory 12 and finds a mismatch. In the event of a mismatch, the control system 102 resets its own PRNG. Simultaneously, the reading operation is detected by circuitry associated with PRNG 14, and thereby causes the PRNG 14 to reset its own algorithm. At this point, typically a few seconds after the initial insertion of module 10, the user removes (effectively disconnects) the module 10 and then re-inserts it into machine 100. The effect of this re-insertion and re-connection is synchronization of the two PRNG's, enabling the ongoing checking of numbers output by the PRNG 14.

In another practical embodiment, the PRNG's are initialized at a predetermined time following the installation of the module 10 into machine 100, and the removal and re-installation described above is not necessary. Unconditionally, on insertion of module 10, both PRNGs are reset; then the machine 100 interrogates the module to get the first number, which is compared to the current number from the base machine PRNG. On a match, normal machine operation is enabled or continued. While machine 100 is operating, there are further periodic interrogations and comparisons of random numbers as they are generated, as described above.

The above-described system provides practical advantages over a straightforward single-password-at install approach. In a simple one-time password system, the valid password(s) in the module must be known beforehand by the machine. This is relatively unsecure because, to overcome the need for a password, many passwords may be tried until one is accepted; and once the single password is discovered, unauthorized modules may be programmed with the valid password. Using only a one-time password check means that, once authenticated, the machine and CRU will run from that point onwards, possibly for the life of the module if the machine is not powered off.

The PRNG 14 may be manifest as an ASIC, or as some sort of general-purpose processor loaded with a suitable algorithm. The module 10 may also have a small on-board power supply 16. In the above-described insertion and re-insertion method, the initial insertion of the module 10 can serve as a momentary charging of the power supply 16.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a machine, comprising:

installing into the machine a module having a first random number generator associated therewith;

incidental to installing the module, initiating a second random number generator associated with the machine;

each of the first random number generator and the second random number generator outputting a series of random numbers over time; and at a predetermined time, checking that a random number recently output by the second random generator is of a predetermined relationship to a random number recently output by the first random number generator.

2. The method of claim 1, further comprising deeming the module acceptable if the random number recently output by the second random number generator is of the predetermined relationship to the random number recently output by the first random number generator.

3. The method of claim 1, further comprising repeatedly checking that a random number recently output by the second random number generator is of a predetermined relationship to a random number recently output by the first random number generator.

4. The method of claim 3, further comprising periodically checking that a random number recently output by the second random number generator is of a predetermined relationship to the random number recently output by the first random number generator.

5. The method of claim 3, wherein the random number generated by one of the first random number generator or the second random number generator effects a time duration between checking that the random number recently output by the second random number generator is of a predetermined relationship to the random number recently output by the first random number generator.

6. The method of claim 1, the installing including connecting the module to the machine;

disconnecting the module form the machine; and re-connecting the module to the machine.

7. The method of claim 6, the connecting including charging a power supply associated with the module.

8. The method of claim 6, the re-connecting effectively causing a synchronization between the first random number generator and the second random number generator.

9. A module installable in an apparatus, comprising:

a random number generator capable of outputting a series of random numbers over time using a PRNG algorithm; and a memory for retaining an initial number to be applied to the random number generator.

10. The module of claim 9, the random number generator being manifest in an ASIC.

11. The module of claim 9, further comprising a power supply operative of at least one of the random number generator and the memory.

12. The module of claim 9, further comprising hardware suitable for printing.

13. The module of claim 9, further comprising hardware suitable for electrophotographic printing.

14. The module of claim 9, further comprising a container for a supply of marking material.

15. A method of operating an electrophotographic printing machine, comprising:

installing into the apparatus a module having a first random number generator associated therewith, the module further including at least one of a container for retaining marking material and hardware suitable for electrophotographic printing;

incidental to installing the module, initiating a second random number generator associated with the machine;

each of the first random number generator and the second random number generator outputting a series of random numbers over time; and at a predetermined time, checking that a random number recently output by the second random number generator is of a predetermined relationship to a random number recently output by the first random number generator.

16. The method of claim 15, further comprising deeming the module acceptable if the random number recently output by the second random number generator is of the predetermined relationship to the random number recently output by the first random number generator.

17. The method of claim 1, further comprising repeatedly checking that a random number recently output by the second random number generator is of a predetermined relationship to a random number recently output by the first random number generator.

18. The method of claim 17, wherein a random number generated by one of the first random number generator or the second random number generator effects a time duration between checking that a random number recently output by the second random number generator is of a predetermined relationship to a random number recently output by the first random number generator.

* * * * *